US007083345B1

(12) United States Patent
Kuwahara

(10) Patent No.: US 7,083,345 B1
(45) Date of Patent: Aug. 1, 2006

(54) ROLL LABEL LAYOUT AND SYSTEM FOR PROPER PRINTING OF NETSTAMPS

(75) Inventor: Tod E. Kuwahara, Pasadena, CA (US)

(73) Assignee: Stamps.com, Santa Monica, CA (US)

( * ) Notice: Subject to any disclaimer, the term of this patent is extended or adjusted under 35 U.S.C. 154(b) by 0 days.

(21) Appl. No.: 10/712,601

(22) Filed: Nov. 12, 2003

(51) Int. Cl.
*B41J 11/26* (2006.01)

(52) U.S. Cl. ..... 400/615.2; 400/613; 700/401; 700/408

(58) Field of Classification Search ..... 400/615.2, 400/611, 613; 705/401, 404, 407–410; 101/71; 283/71
See application file for complete search history.

(56) References Cited

U.S. PATENT DOCUMENTS 5,325,303 A * 6/1994 Walz et al. ..... 705/404
5,848,401 A * 12/1998 Goldberg et al. ..... 705/408
2001/0042052 A1* 11/2001 Leon ..... 705/401
2002/0040353 A1* 4/2002 Brown et al. ..... 705/401
2002/0073039 A1* 6/2002 Ogg et al. ..... 705/60

* cited by examiner

*Primary Examiner*—Minh Chau
(74) *Attorney, Agent, or Firm*—Christie, Parker & Hale, LLP

(57) ABSTRACT

A system for assisting a user with the proper printing of postage indicia and other value bearing items onto labels in rolls of labels in a label printer, and a roll for use therewith. The system includes providing a roll bearing pre-printed labels for printing with postage indicia. The roll has a plurality of label sets, each with a leader portion and a label body, where each leader has a serial number which is the same as a serial number located on its corresponding label body. Interactive computer software guides a user to confirm that the serial number on the pre-printed label body to be printed with postage indicia matches a label serial number in the software that will be encoded into a 2-D barcode portion of the postage indicia.

16 Claims, 9 Drawing Sheets

ROLL LABEL LAYOUT AND SYSTEM FOR PROPER PRINTING OF NETSTAMPS

SUMMARY OF THE INVENTION

The invention relates to the field of systems and layouts for printing indicia on a roll of labels, and more particularly, to a roll label layout and system for assisting a user with the proper printing of postage indicia on labels of a roll of unprinted labels, so that the indicia can be properly printed on the unprinted labels without wasting any labels or postage value, and a label layout for use with the system.

In Stamps.com's co-pending patent application Ser. No. 10/429,642, filed May 5, 2003, and entitled "SYSTEM AND LAYOUT FOR PROPER PRINTING OF NETSTAMPS AND OTHER LABELS", by Craig Ogg et al., there is disclosed a system and layout for proper printing of NetStamps™ and other labels on sheets of labels with postage indicia. The system of this patent application provides a solution to the problem of some misprints that can be caused if a user feeds a sheet of blank labels into a printer in an incorrect orientation.

Stamps.com has recently commercially introduced its NetStamps™ labels and system, which are specialized sheets of labels and software for use therewith, whose labels are designed to be printed with postage indicia but not a date code or a mailing address code. Stamps.com's NetStamps™ labels can be printed with postage indicia one at a time (e.g. the postage rate for a first class stamp), a range of labels, or an entire sheet can be printed with the same postage value. Since the process of printing an entire sheet of labels with indicia carries the risk of printing an entire sheet of labels incorrectly and thus creating invalid postage, it is important that these label sheets be fed into the printer in the proper orientation. Computer printers often vary from manufacturer to manufacturer and model to model as to how label sheets must be fed in for properly oriented printing. Users can sometimes become confused, make errors and forget how to feed blank label sheets into printers, and accordingly, make errors and print invalid postage labels.

These NETSTAMPS™ postage bearing labels can be printed one at a time or in a batch in the values and quantities needed, and used anytime in the future, much like conventional preprinted stamps. U.S. Postal System regulations for these types of postage require that in addition to a 2-D bar code that contains imbedded information including a unique serial number for each individual stamp, that there also be provided human readable code on each stamp as to the serial number of each particular postage label. In the case of sheets and rolls of blank postage labels, each label thereon has a unique pre-printed serial number. For example, the serial number might be 261000001.001, which represent a unique serial number for a label. In one embodiment of the NetStamps™ system, each separate label on a sheet of labels is preprinted with its serial number. This serial number is entered during a process of preparing to print each label with indicia. The sheet of labels can also be printed in its margin area with a serial number.

In the process of preparing to print blank postage labels with postage indicia, the user provides and/or confirms certain information including the postage information and the serial number of the label or labels to be printed with postage indicia. When the label or labels are printed with postage indicia, this information will be imbedded in the non-human readable 2-D bar code section, and is scannable by mail handling equipment. In the case of sheets of blank postage indicia labels, the user can, before placing the blank sheet(s) of labels into the printer's paper feed tray or inlet, examine the blank sheet(s) of labels and input into the system software the sheet and the serial number of the label or labels to be printed with postage indicia. By so doing, the user can insure that the proper 2-D bar code information that will be printed on each label will actually match the preprinted information, viz. the serial number of the label or labels to be printed with postage indicia.

While Stamps.com's invention for sheets of specialized postage indicia labels provides a solution to the problem of misprints on sheets of NETSTAMPS™, there remains some issues with another popular label format, namely, rolls of postage indicia printable labels. In the case of roll labels, there exist dedicated roll label printers that connect to computers, for example, Dymo brand printers, by the Esselte Corporation. In the use of roll label printers, a user will typically load a roll of labels into the roll label printer which readies the roll label printer and roll available for immediate use. One advantage of roll label printers is that these types of printers are dedicated to print just labels, and a user can more easily print a single label or group of labels without having to feed in paper or interrupt other print jobs. However, most label printers are designed such that at least a portion of the next label to be printed will remain concealed inside the roll label printer. This makes it difficult for a user to view the label positioned to be printed, and therefore a user may inadvertently improperly enter a stamp or stamps' serial number into the software, which can result in misprinted postage indicia label or labels being printed, wherein the serial number printed on the postage indicia label conflicts with the serial number imbedded in the 2-D barcode. If this occurs, the label and postage is wasted.

The U.S. Postal Service ("USPS") maintains very strict requirements that PC postage users must adhere to with respect to processing and refunding misprinted postage. Currently, physical proof of misprints is required for money to be reimbursed by the USPS. When a user misprints and seeks to obtain a refund, the process is both time consuming and troublesome. A user must often wait several weeks for a misprint reimbursement request to be processed, and during this time they will not have replacement funds in their PC mail meter. Misprints can therefore be more costly up front for a user if they must put additional postage into their meter before obtaining a refund. While printing one label on a roll with the wrong serial number may be bad enough, misprinting a range of several labels can become even more burdensome and costly.

It is accordingly desirable to have provided a roll label layout and system for assisting a user with the proper printing of postage indicia and other value bearing items on labels of a roll of unprinted labels.

DETAILED DESCRIPTION OF THE INVENTION

Roll label printers are ideal for printing NetStamps™ style of postage indicia. A problem with printing NetStamps™ however, is ensuring that users correctly provide the serial number into software before printing is initiated, because if the wrong serial number is put into software, the printed NetStamps™ will be defective. With roll label printers, once a roll is loaded into the printer, it is difficult for the user to see the serial number on the label. This problem is not experienced with unprinted sheets of NetStamps™ labels, which a user handles before being placed into conventional label printers.

The system of the invention provides a way for users to determine what is the serial number of a leading label of the currently loaded roll of NetStamps™ labels, and thereby avoid misprints.

Figure 1:
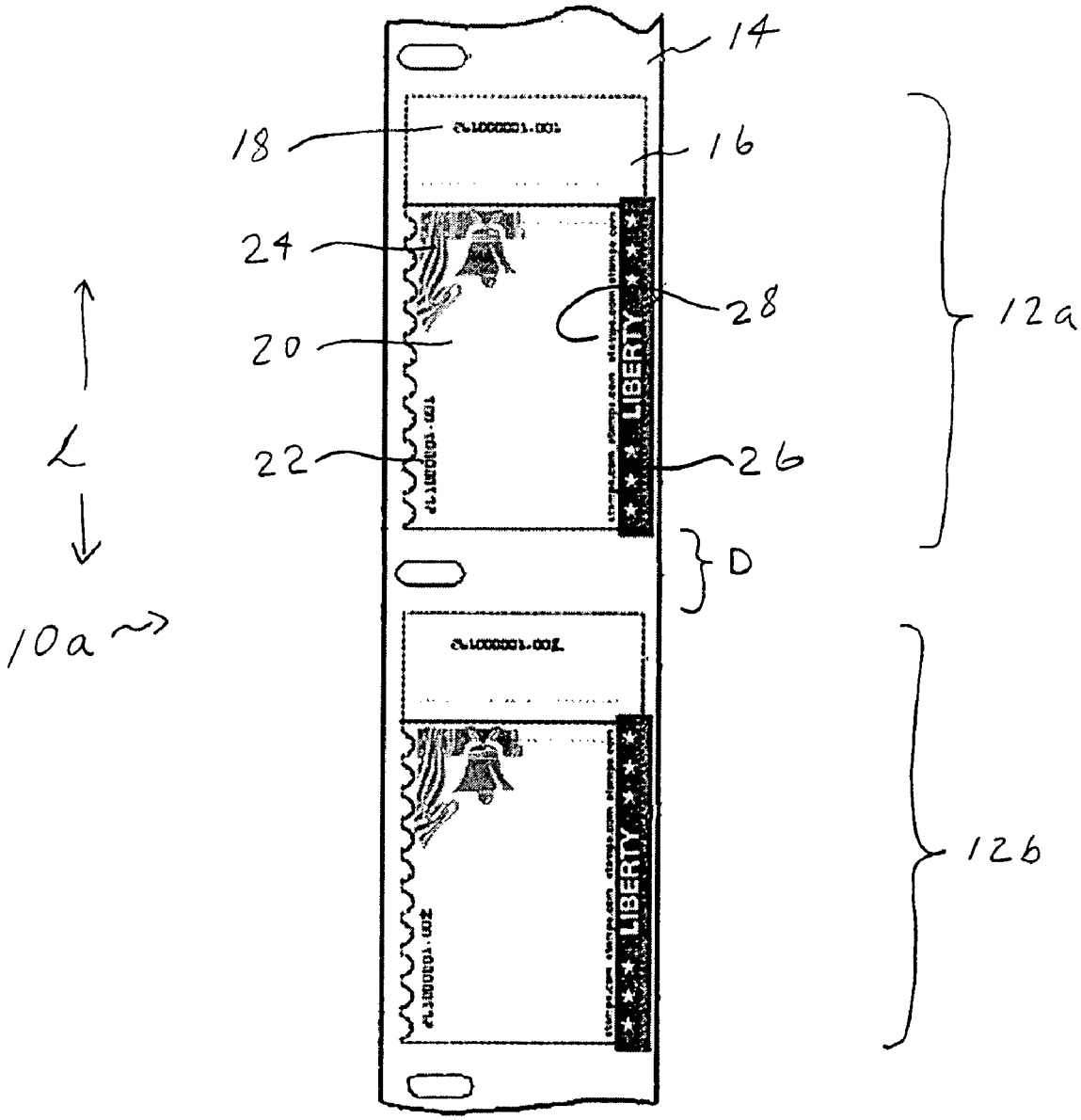
FIG. 1 is a top plan view of one exemplary embodiment of postage indicia labels on a carrier of the invention.
Figure 2:
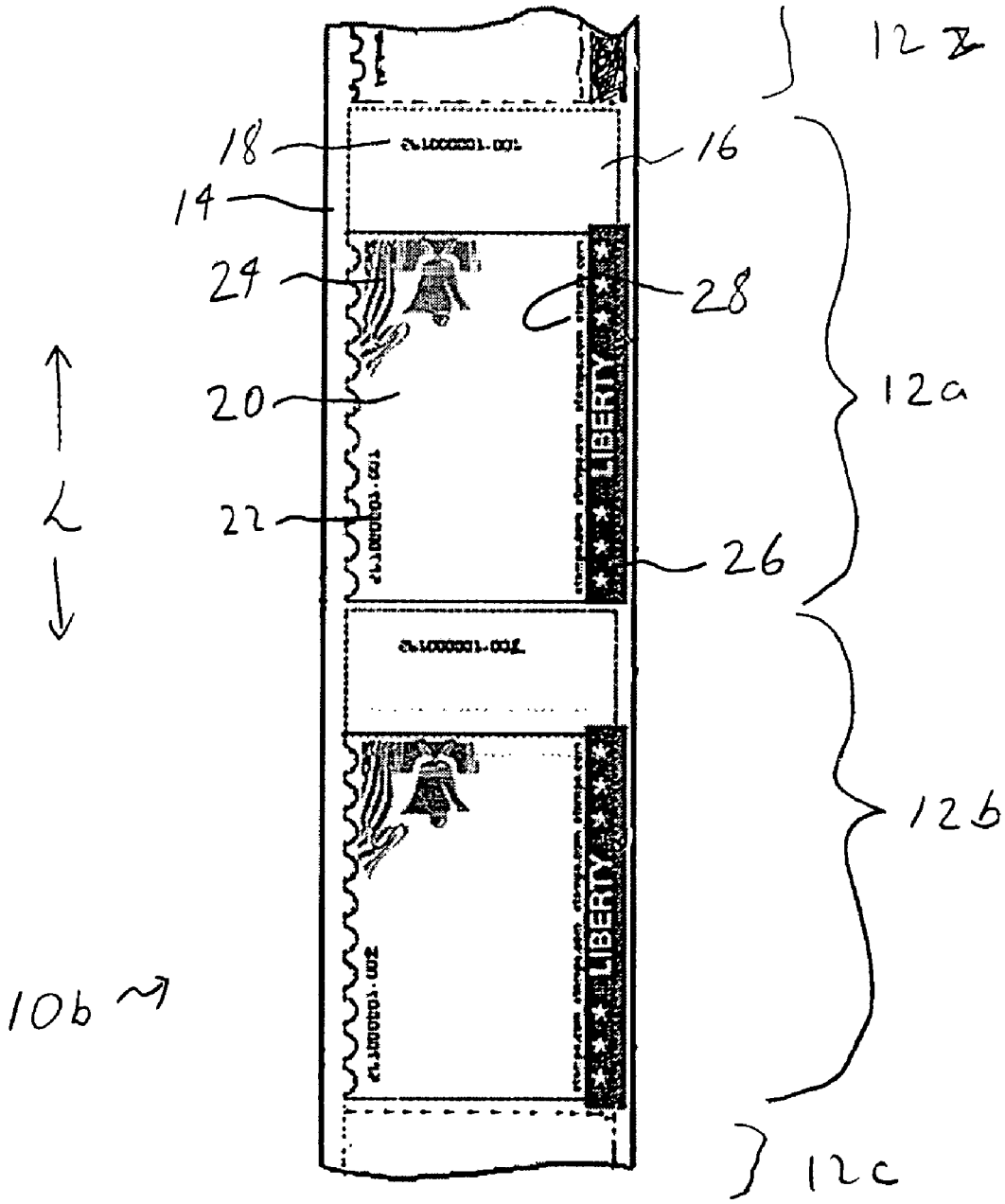
FIG. 2 is a top plan view of another exemplary embodiment of postage indicia labels on a carrier of the invention.

Referring to FIGS. 1 and 2, the form factor for the roll of NetStamps™ labels 10*a* and 10*b*, respectively, will consist of a plurality of two part sets 12*a*, 12*b*, etc. on a carrier 14. (A portion of roll is shown.) The first part 16 of each set has a unique serial number 18 printed thereon in one orientation, e.g., a horizontal orientation (perpendicular to the long axis "L" of roll.) A second part 20 of each set comprises a releasable label borne on carrier 14 and if desired can have the same appearance of a NetStamps™ style of label that will be printed on sheets of labels, or can be different. The second part bears the same unique serial number 22 as appears on first part 18, but typically is placed in another orientation, e.g., in a vertical orientation along the long axis "L" of roll. In addition, second part 20 can optionally be pre-printed with a thermalchromatic printed logo element 24, a facing mark 26, and possibly also a line of microprinting 28. A plurality of two part sets 12*a*, 12*b*, etc., may appear on carrier 14 spaced apart by distance "D" (see FIG. 1), or sets 12*a*, 12*b*, etc. can be placed directly next to each other without any appreciable spacing, as shown in FIG. 2. First part 16 can comprise a separate label portion that is borne on carrier 14.

Figure 3:
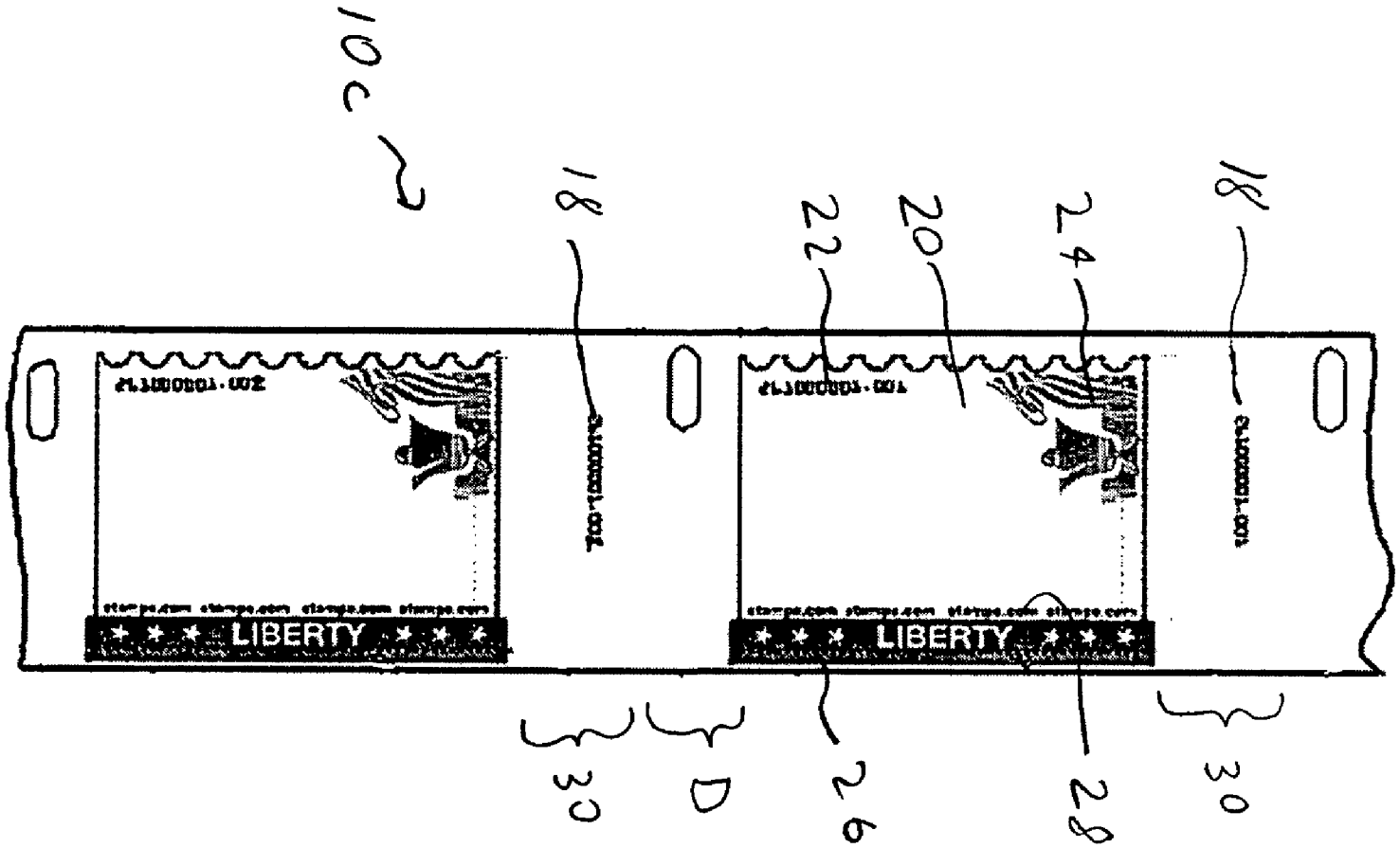
FIG. 3 is a top plan view of a further exemplary embodiment of postage indicia labels on a carrier of the invention.

Referring to FIG. 3, the roll of NetStamps™ labels 10*c* can comprise a region 30 of carrier 14 upon which is directly printed unique serial number 18, without the presence of a bona fide removable label. In this case, there is a single removable label with a unique serial number, but the unique serial number 18 is still visible to the user prior to printing the single label with postage indicia.

Figure 4:
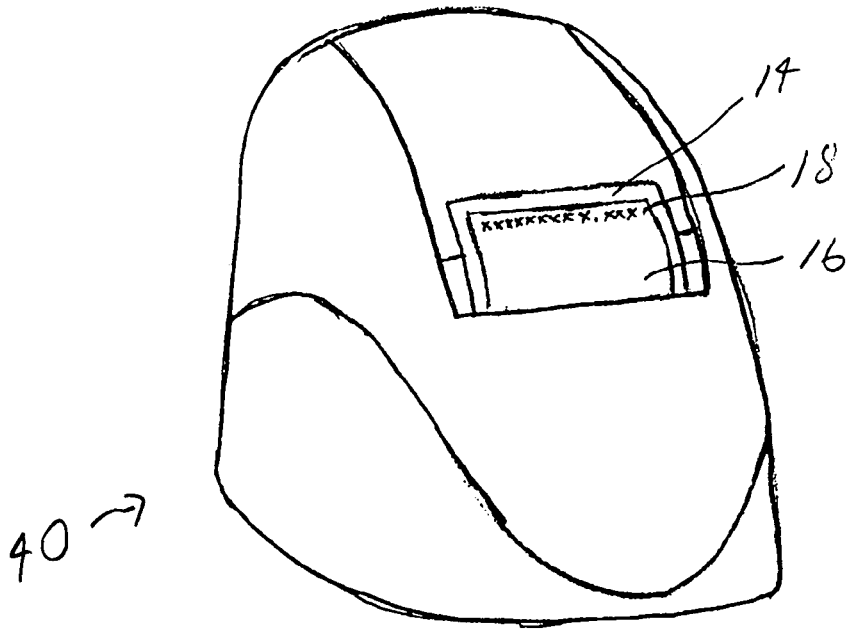
FIG. 4 is a perspective view of the leader portion of a roll of exemplary postage indicia labels bumped out of an exemplary roll label printer.

Referring to FIG. 4, there is shown a perspective view of an exemplary roll label printer 40 with first part 16 of a two part set on carrier 14 extending therefrom to reveal its serial number 18. This is the position that the first label to be printed in a print run will have so that the user can verify that the serial number shown in the software matches the serial number of the first to be printed label. Second part 20 (not shown) of a label set can be totally or partially concealed within roll label printer 40 and be ready for printing with postage indicia.

Figure 5:
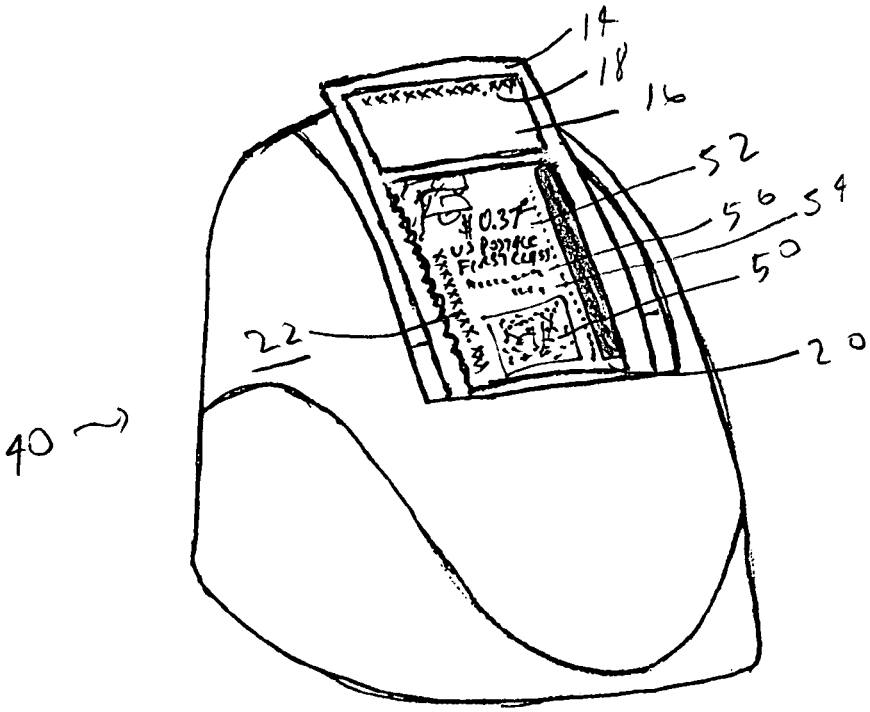
FIG. 5 is a perspective view of the leader portion and postage indicia printed label body of a roll of exemplary postage indicia labels after printing by a roll label printer.
Figure 6:
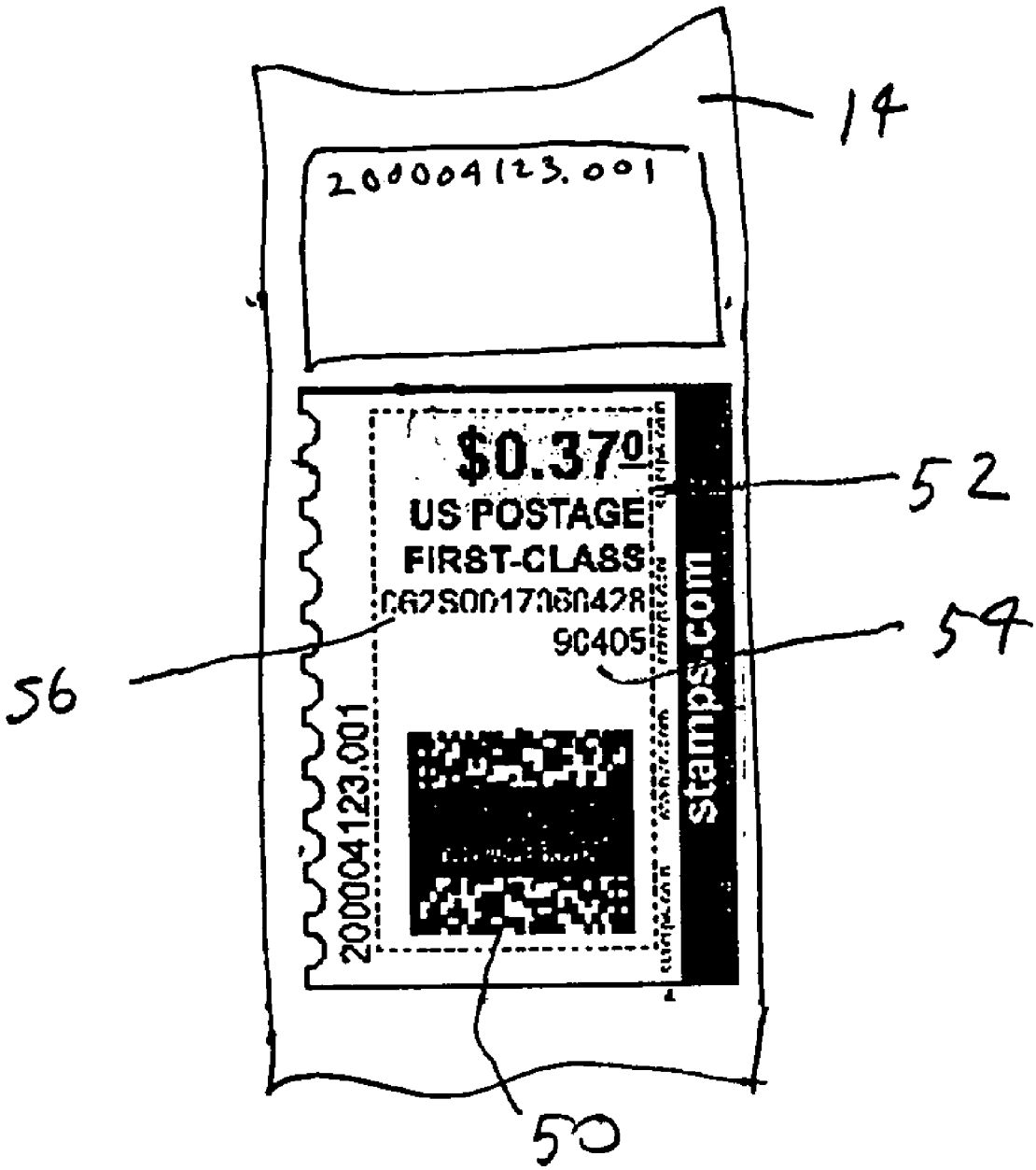
FIG. 6 is a top plan view of a single postage indicia label sets after its label body has been printed with postage indicia.

FIG. 5 is a perspective view of exemplary roll label printer 40 with one label set 12 fed out of roll label printer 40 after second part 20 has been printed with postage indicia and other information. As can be seen, after printing, first and second parts 16 and 20 of a two part label set 12 will extend from the roll label printer 40. After printing, second part 20 will be printed with the 2-D bar code 50 that encodes the postage value and type, sender information and the serial number, and in human readable form, the postage value and postage class 52, the sender's ZIP code 54, and other sender information code 56, which is better shown in FIG. 6. In the case that multiple labels were printed, then multiple sets of labels would extend from the label printer (not shown.)

Figure 7:
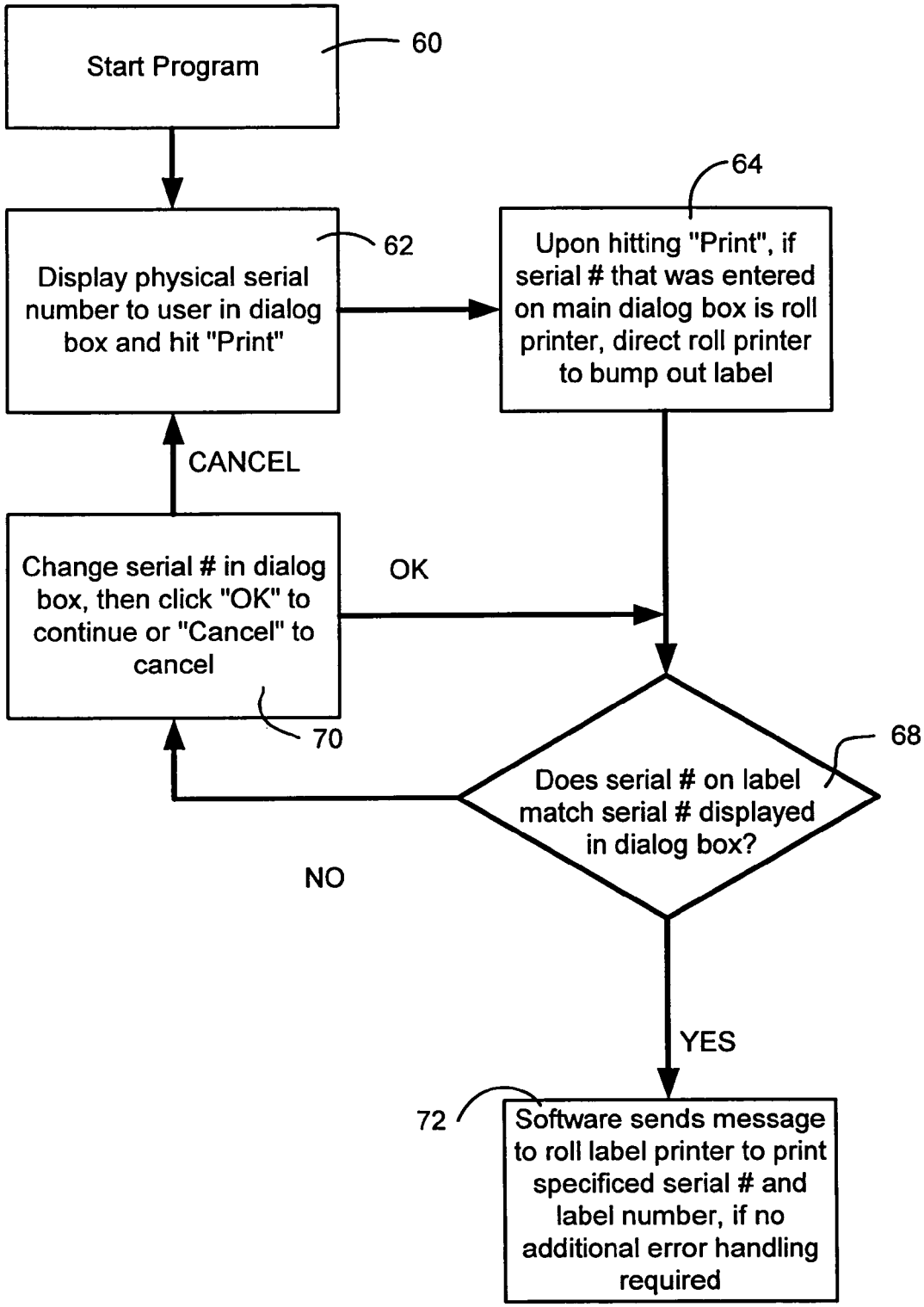
FIG. 7 is an exemplary flow chart of a software system of the invention.

Referring to FIG. 7, there is shown an exemplary flow chart showing one possible embodiment of the system of the invention. In use of the system, first part will be feed out of a roll printer for serial number verification purposes prior to printing of second part with postage indicia. One exemplary embodiment of the serial number verification process is as follows. The program is first started 60. The software displays a physical serial number to the user in a dialog, and the user is asked to hit a "Print" button 62. Upon hitting the "Print" button 62, if the physical serial number that was entered in a dialog box indicates that the user is printing to a roll of labels in the label printer, then the software will send a command to the roll label printer to feed, or "bump out" the label set by a predetermined amount 64. Most roll printers support a SKIP command that can be used to advance a label a specified number of lines. This is done to a sufficient degree to reveal at least enough of the first part of the label set (e.g. 1.6 cm (⅝") so that its horizontally positioned serial number 18 can be viewed by the user even though the second part 20 of the label set is positioned for printing.

Figure 9:
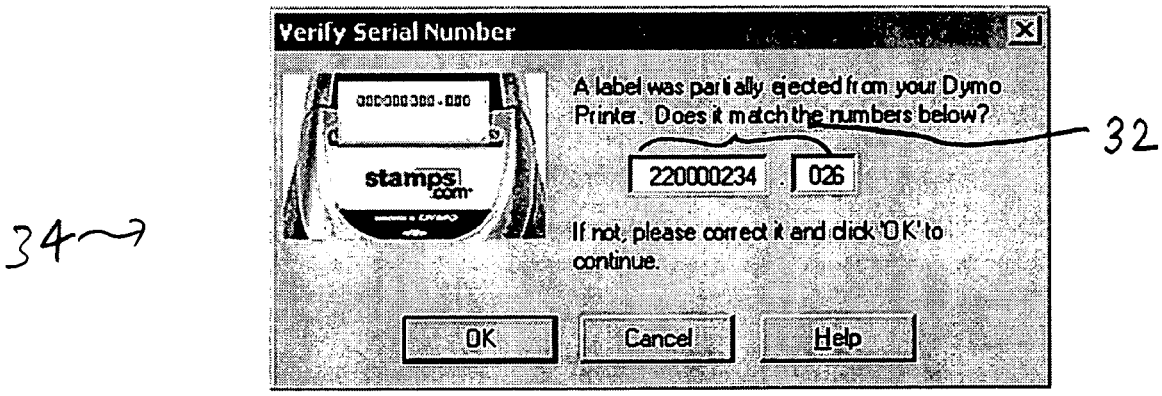
FIG. 9 is an exemplary verify serial number dialog box for the software system of the invention.

The software will display a physical serial number 32 to the user. This can be done on screen, such as with an exemplary dialog box 34 as shown in FIG. 9 and in step 66 of FIG. 7. Within the dialog box 34, the user is queried whether the serial number on the first part of the label matches the serial number displayed in dialog box 68. If it does not, then user is given the option to either correct the serial number in the software to match what is shown in the display box to verify that the displayed serial number matches the number in the software 70, or to cancel the print step, in which case the user can be taken back to a main dialog box 62. If the serial number on the first part of the label matches the serial number displayed in dialog box 68, the software will send a message to the roll label printer to print the specified serial number and label number, if no additional error handling is required 72. As noted above, it is essential that the serial number(s) on the label(s) being printed match what the computer software is directing the printer to print on each label, otherwise the labels printed with postage indicia will be invalid. The system allows a user to print more than one postage indicia label at a time, e.g. 2 to 25 postage indicia stamps with first class postage.

Figure 8:
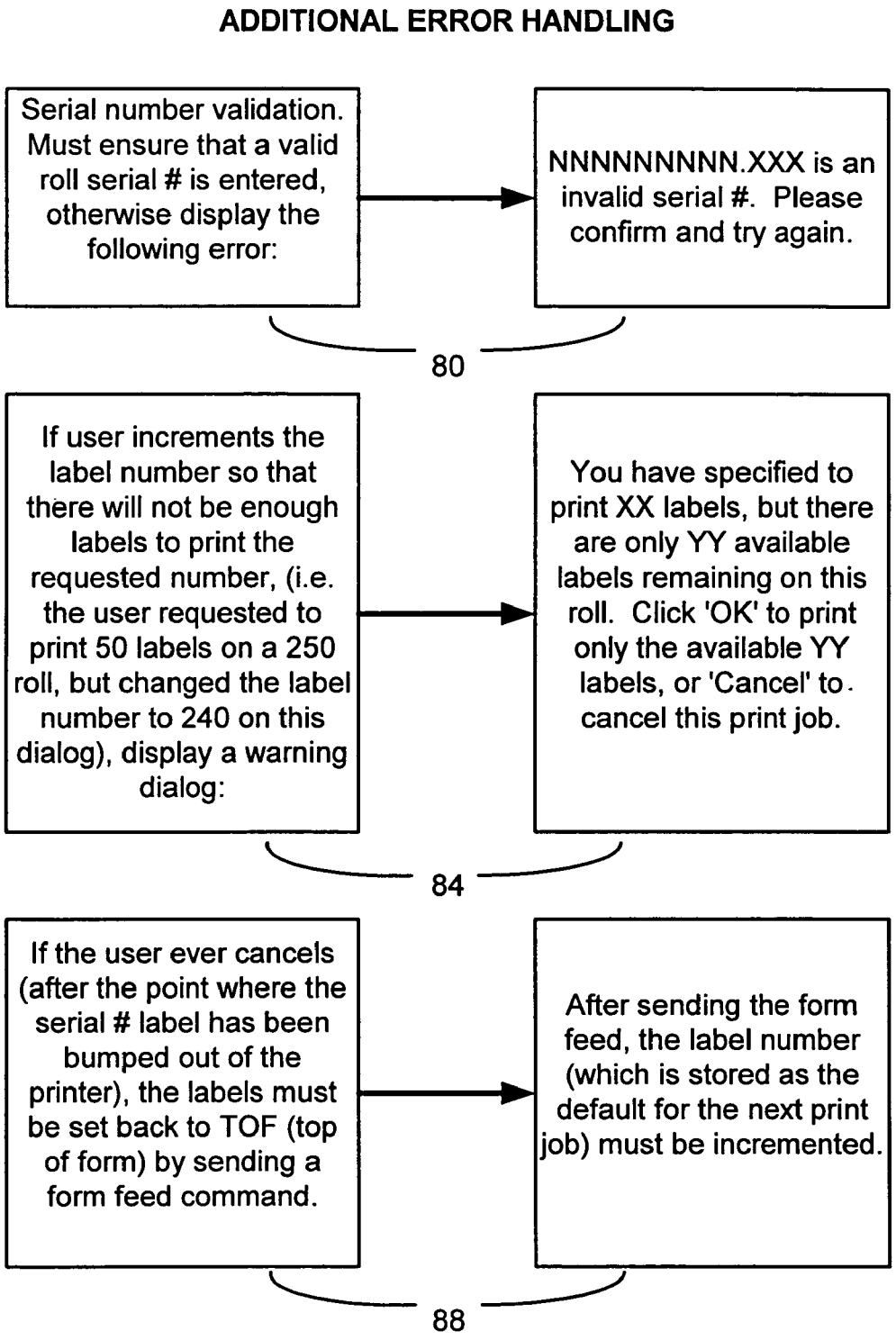
FIG. 8 is an exemplary error handling protocol for the software system of the invention.

The system provides error control mechanisms that will help prevent a user from making common mistakes. See FIG. 8. For example, the system can help prevent a user from entering an invalid serial number into the software, and can display a message such as "NNNNNNNNN.NNN is an invalid serial number. Please confirm and try again" 80. Another error control can be that if a user attempts to print more postage indicia stamps than there are blank labels remaining on the roll of labels loaded in the roll printer, the software will warn the user of this fact. For example, if the user increments the label number to a point where there will not be enough labels to print the requested number of labels, i.e. the user requests printing 50 labels on a 250 roll, but changed the starting label number to 240 on this dialog, the system can display a warning dialog, such as "You have specified to print XX labels, but there are only YY available labels remaining on this roll. Click 'OK' to print only the available YY labels, or 'Cancel' to cancel this print job" 84. If the user ever cancels (after the point where the serial number label has been bumped out of the printer), the labels must be set back to TOF (top of form) by sending a form feed command. In this case, after sending the form feed message, the label number (which is stored as the default for the next print job) must be incremented 88.

Figure 10:
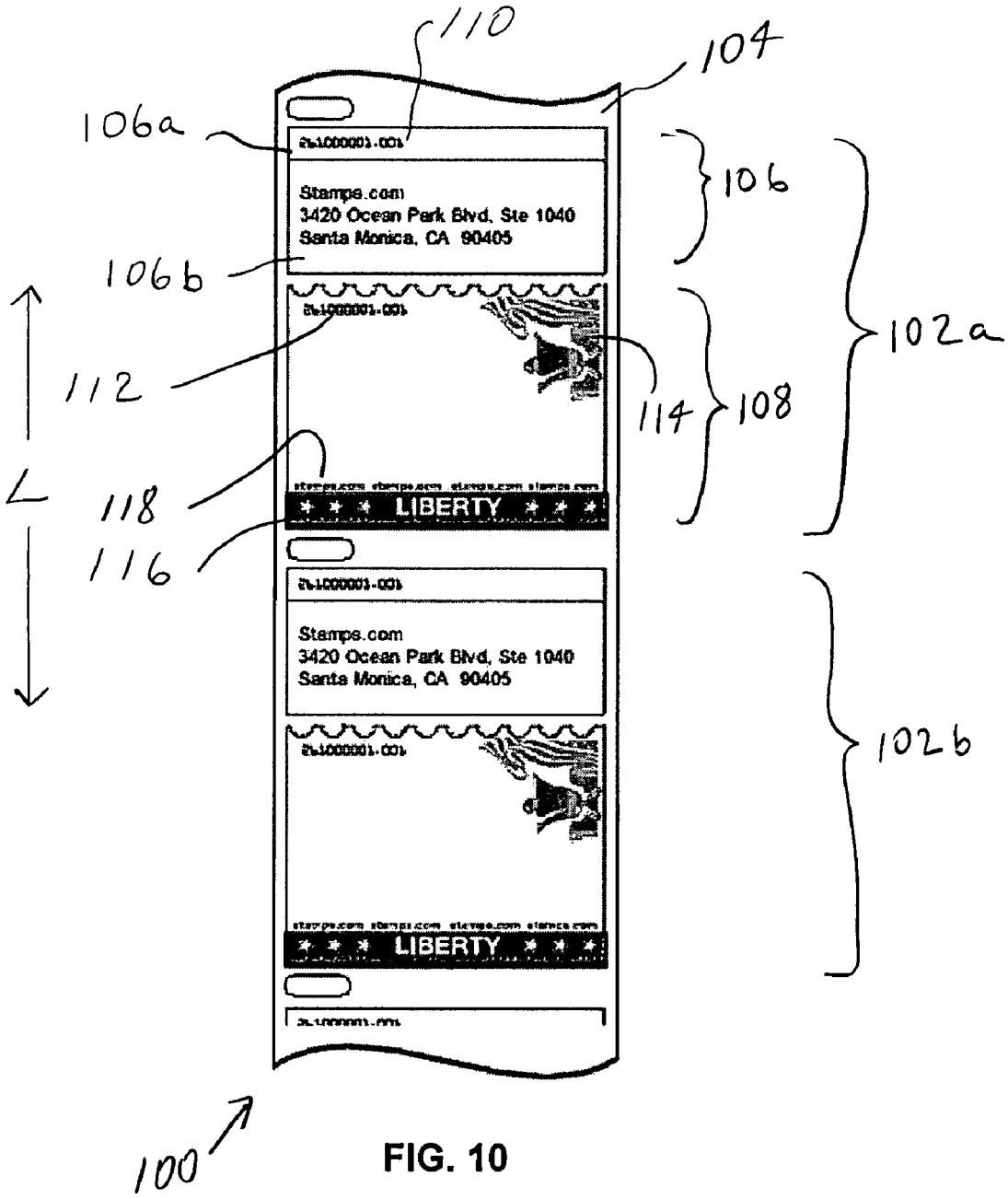
FIG. 10 is a top plan view of another exemplary embodiment of postage indicia labels on a carrier of the invention.

Turning now to FIG. 10, there is shown a top plan view of another exemplary embodiment of a roll of postage indicia labels 100. The roll comprises a plurality of label sets 102*a*, 102*b*, etc. on a carrier 104. (A portion of a roll is shown.) Each label set consists of a leader portion 106 and a releasable main body portion 108. The main body portions 108 can have the appearance and features of Netstamps™ postage indicia labels. If desired, the leader portion 106 can be divided into a serial number bearing portion 106*a* and a supplemental information bearing portion 106*b* (e.g. which supplemental information bearing portion 106*b* can be printed with information such as a sender's return address so that it may be used as a return address label.) The serial number bearing portion 106*a* can be made to be narrower than the supplemental information bearing portion 106*b*. By providing the leader portion 106 in two parts, a user can use just the supplemental information bearing portion 106*b* without including the serial number bearing portion 106*a*. As with other above described embodiment of the roll label sets, a unique serial number 110 is pre-printed on leader portion 106 in a horizontal orientation relative to the long axis L of the roll of roll label set and the same unique serial number 112 is pre-printed on the main body portion 108 of the same label set. However, in the case of Netstamp™ types of postage indicia labels 108, they are arranged on the roll with their unique serial numbers 112 aligned horizontally in the same horizontal orientation as the corresponding serial numbers 110 of the leader portions 106. An advantage for arranging the main body portion 108 this way is that since Netstamp™ types of postage indicia labels 108 are typically not square and are taller than they are wide, this arrangement can accommodate a wider leader portion 106 which in turn can better serve as a return label. The main body portion 108 can optionally be pre-printed with a thermalchromatic printed logo element 114, a facing mark 116, and possibly also a line of microprinting 118.

As with the other embodiments of the system, the systems using roll label printers with built in OCR and/or bar code scanners described above can be used to print a single postage indicia label, or a range of labels that a user wishes to print.

While the invention has been primarily described with reference to postage indicia label sets and methods of using these label sets, these rolls and systems can be used for printing other value bearing indicia, such as tickets, coupons and traveler's checks, to name just a few. In these cases, rather than the labels being carried on a carrier, the items being printed may form part of the roll.

Having thus described exemplary embodiments of the present invention, it should be understood by those skilled in the art that the above disclosures are exemplary only and that various other alternatives, adaptations and modifications may be made within the scope of the present invention. The presently disclosed embodiments are to be considered in all respects as illustrative and not restrictive.

What is claimed is:

1. A method for assisting a user with the proper printing of postage indicia onto labels in rolls of labels in a label printer, the method comprising:

providing a roll bearing pre-printed labels for printing with postage indicia, the roll having a plurality of label sets, each with a leader portion and a label body, where each leader has a serial number which is the same as a serial number located on its corresponding label body; and providing interactive computer software that guides a user to confirm that the serial number on the leader portion matches a label serial number in the software.

2. The method of claim 1, wherein the plurality of label sets are positioned on a carrier.

3. The method of claim 2, wherein the plurality of label set are positioned in a spaced apart orientation on the carrier.

4. The method of claim 2, wherein each leader comprises a separate label element that is positioned on the carrier adjacent to its corresponding label body portion.

5. The method of claim 2, wherein each leader comprises a portion of the carrier adjacent to its corresponding label body upon which is printed the same serial number.

6. The method of claim 1, wherein the method permits the user to correct the serial number in the software prior to printing the postage indicia.

7. The method of claim 1, wherein the software queries the user as to a range of serial numbers to be pre-printed with postage indicia onto a range of label bodies.

8. The method of claim 1, wherein the software has error control features which at least one of warns a user if a serial number entered into software is an invalid number, warns a user if the number of label bodies on the roll of labels to be printed are less than a number of labels a user wishes to print with postage indicia, and will automatically feed a leader portion back into a printer if a user decides not to print labels with postage indicia.

9. The method of claim 1, wherein the leaders of each label set are adjacent to their respective label body.

10. The method of claim 1, wherein the serial number is located horizontally on the leader portion, and the serial number is located vertically on the label body.

11. The method of claim 1, wherein the serial number is located horizontally on both the leader portion and the label body.

12. The method of claim 11, wherein the leader portion is divided into a serial number bearing portion and a supplemental information bearing portion.

13. A method for assisting a user with the proper printing of postage indicia onto labels in rolls of labels in a label printer, the method comprising:

providing interactive computer software that guides a user to confirm that a serial number on a label in a roll of labels to be printed with postage indicia matches a label serial number in the software, wherein the method permits the user to correct the serial number in the software prior to printing a label with postage indicia.

14. A method for assisting a user with the proper printing of postage indicia onto labels in rolls of labels in a label printer, the method comprising:

providing interactive computer software that guides a user to confirm that a serial number on a label header and a label body of a label set in a roll of label sets to be printed with postage indicia matches a serial number in the software, wherein the software queries the user as to a range of serial numbers of labels to be printed with postage indicia.

15. A method for assisting a user with the proper printing of postage indicia onto labels in rolls of labels in a label printer, the method comprising:

providing interactive computer software that guides a user to confirm that a serial number on a label in a roll of labels to be printed with postage indicia matches a serial number in the software, wherein the software has error control features which one of at least warns a user if a serial number entered into software is an invalid number, warns a user if the number of labels in a roll of labels to be printed is less than a number of labels a user wishes to print with postage indicia, and will automatically send a message to a printer to withdraw a label back into the printer if the user decides not to print labels with postage indicia.

16. A method for assisting a user with the proper printing of value bearing indicia onto labels in rolls of labels in a label printer, the method comprising:

providing a roll bearing pre-printed labels for printing with value bearing indicia, the roll having a plurality of label sets, each with a leader portion and a label body, where each leader has a serial number which is the same as a serial number located on its corresponding label body; and providing interactive computer software that guides a user to confirm that the serial number on the leader portion matches a label serial number in the software.

* * * * *